United States Patent [19]

Hawkins

[11] 4,204,351

[45] May 27, 1980

[54] ROTARY CARD INDEX SYSTEM

[75] Inventor: Graham S. W. Hawkins, Coulsdon, England

[73] Assignee: Business Efficiency Aids, Inc., Skokie, Ill.

[21] Appl. No.: 823,835

[22] Filed: Aug. 11, 1977

[30] Foreign Application Priority Data

Aug. 18, 1976 [GB] United Kingdom ..... 34369/76

[51] Int. Cl.[2] ..... G09F 11/04

[52] U.S. Cl. ..... 40/372; 40/379

[58] Field of Search ..... 40/372, 377, 378, 379, 40/401; 402/26, 70; 281/42; 116/324; 312/186, 59

[56] References Cited

U.S. PATENT DOCUMENTS

| | | | |
|---|---|---|---|
| 1,476,157 | 12/1923 | Fleming | 40/372 |
| 1,533,735 | 4/1925 | Hines | 40/377 |
| 1,596,225 | 8/1926 | Andersson | 281/42 |
| 2,180,490 | 11/1939 | Vogel | 40/392 X |
| 3,126,235 | 3/1964 | Gray et al. | 402/70 |
| 3,261,649 | 7/1966 | Erickson et al. | 40/379 X |

FOREIGN PATENT DOCUMENTS

| | | | |
|---|---|---|---|
| 720944 | 12/1954 | United Kingdom | 40/379 |

*Primary Examiner*—Richard C. Pinkham
*Assistant Examiner*—Scott L. Brown
*Attorney, Agent, or Firm*—Trexler, Wolters, Bushnell & Fosse

[57] ABSTRACT

A rotary card index system including a card carrying drum rotatably mounted on a support frame and a pivotal plate member mounted on said frame for movement to and from a retracted inoperative position and an operable position between adjacent cards for maintaining the adjacent cards in spaced relationship.

13 Claims, 10 Drawing Figures

ROTARY CARD INDEX SYSTEM

BACKGROUND OF THE INVENTION

This invention relates to a rotary index system of the type comprising a plurality of cards extending radially from a central rotatable drum.

In such a system, information is normally typed on the faces of the cards, and a desired card may be selected by rotating the drum until the card appears on the upper side of the drum. In order to read the information on the card, adjacent cards must normally be held out of the way to expose the face of the card. This normally requires the use of a hand although a typist, for example, will often place a pencil or other object between adjacent cards to separate them. To move on to the next card, in this case, the pencil is normally removed with one hand and the drum rotated with the other. It can be seen, therefore, that both hands are occupied, and when carrying out repetitive operations, such as typing addresses, this can slow the typist considerably.

Index systems of this type are known where each card carries a small magnetic strip to separate partially the cards. Such an arrangement allows the user to read the top of the card and facilitates the separation of the cards, but does not allow the reader to see the whole of the face of a card, owing to the large number of cards normally mounted on the drum.

SUMMARY OF THE INVENTION

Accordingly, the present invention provides a rotary index system of the type defined including a small plate pivotally mounted on the frame of the system so as to fall, under its own weight, between adjacent cards when they are held apart by hand, the plate thus holding the cards apart and allowing the hand to be removed, and the plate being further mounted and shaped so as to flip out of the way of the cards when the drum is rotated.

Preferably, the index system is of the type in which the individual cards carry magnetic strips to separate them.

Conveniently, the plate is rectangular with a small outwardly turned lip at one end. The lip, in this case, is provided with a pair of oblong holes extending into the main body of the plate. A small staple extends through the holes to provide a rolling and pivoting action which enables the plate to flip free of the cards when the drum is rotated.

DETAILED DESCRIPTION OF THE INVENTION

Figure 1:
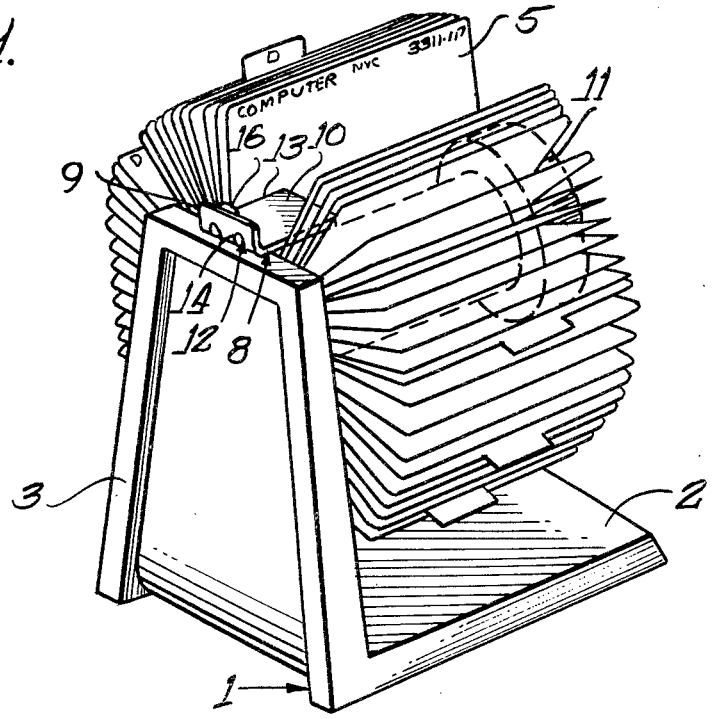
FIG. 1 is a perspective view of a rotary index system with a plate separating adjacent cards.

In the drawings, the rotary index system comprises a frame 1 having a base 2 and a side wall 3. A drum 4 is rotatably mounted on the side wall 3 and carries a series of radially extending cards 5. A hand knob 11 is fixed to one end of the drum to enable an operator to rotate the drum. The cards 5 are, in fact, mounted on two hoops 6 which are fixed to the drum 4 and extend through apertures 7 in the bases of the cards 5.

A small generally rectangular plate 8 has an outwardly turned lip 9 extending substantially at right angles to the plane of the main body 10 of the plate 8. A pair of substantially elliptical spaced apart apertures 14 are formed in the portions 9 and 10 so as to extend across the curved or corner region 15 where the lip 9 meets the main body 10. The plate 8 is loosely pivotally connected to the upper edge of the side wall 3 of the rotary index system by means of a small upstanding inverted U-shaped stapel 12 having spaced upstanding leg elements 17, extending through the apertures 14 and joined by a rounded upper end or bight portion 16.

Figure 2:
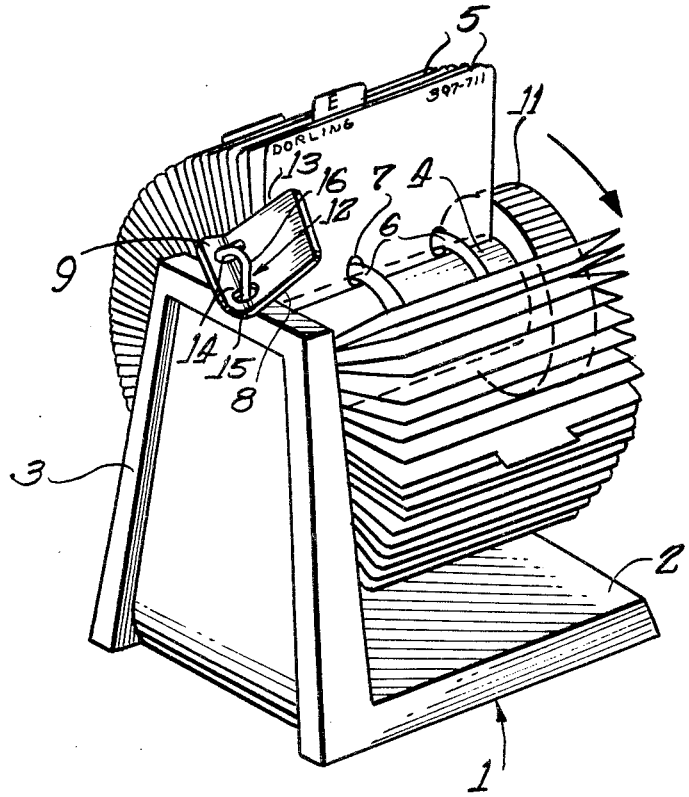
FIG. 2 is a view of the system with the plate being flipped out of the way.
Figure 4:
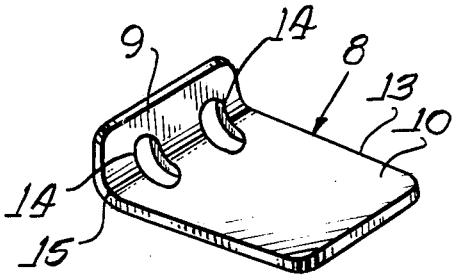
FIG. 4 is a view of the plate alone.

In operation, the drum 4 is rotated by means of a knob 11 until the desired card is upper most. The card in front is then separated with the finger to expose the face of the selected card and, at the same time, allow the plate 8 to fall into position between the cards and thus hold them apart as shown in FIG. 1. When it is desired to move on to the next card, the drum is further rotated, by means of the knob 11, in an anti-clockwise direction as shown (although the system operates in either direction) causing the exposed card 5 to press against a rear edge 13 of the plate portion 10. The curvature of the staple 12 and the effect of the elliptical apertures 14 cause the plate 8 to perform a pivotal and rolling motion, thereby to flip out of the way of the cards, as shown in FIG. 2. It is noted that the edge is tapered or rounded toward the outer free end of the portion 10 for further promoting a "camming" action by the cards causing the plate to pivot or roll about axes respectively extending generally angles to each other and transversely of and generally longitudinally of the elliptical apertures 14 as shown in FIG. 2.

Figure 3:
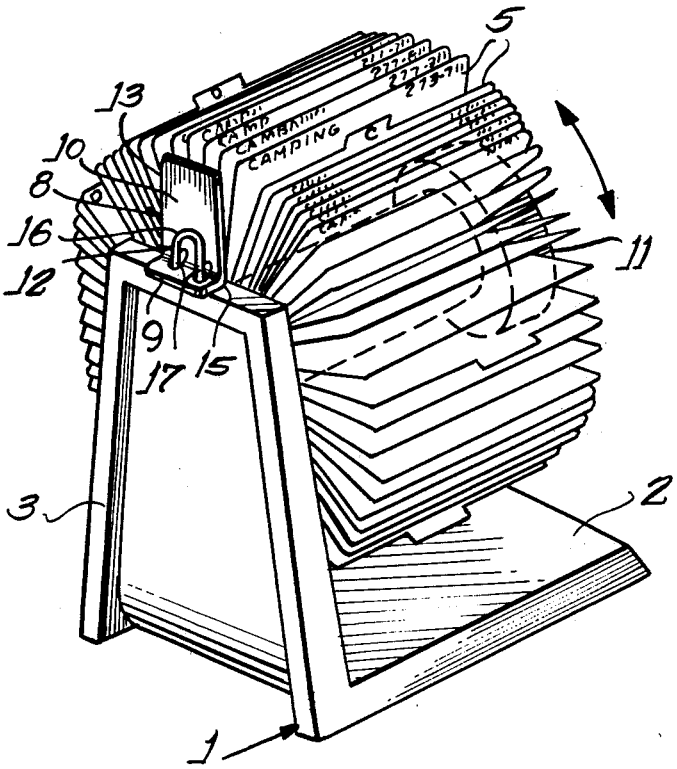
FIG. 3 is a view of the system with the plate clear of the cards.

On further rotation of the drum 4, the plate 8 stands clear of the cards 5, as shown in FIG. 3, thus enabling the drum to be freely rotated in either direction.

Figure 5:
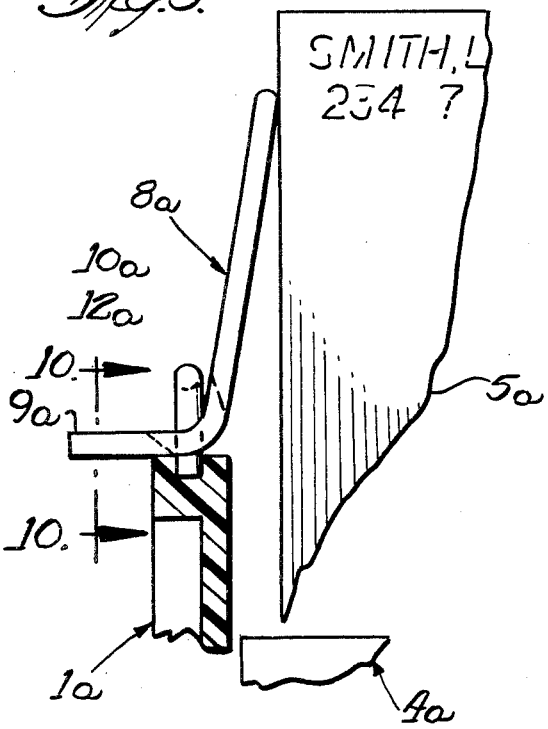
FIG. 5 is a large fragmentary partial sectional view of a rotary index system incorporating a modified form of the present invention and shows the plate in a retracted position.
Figure 6:
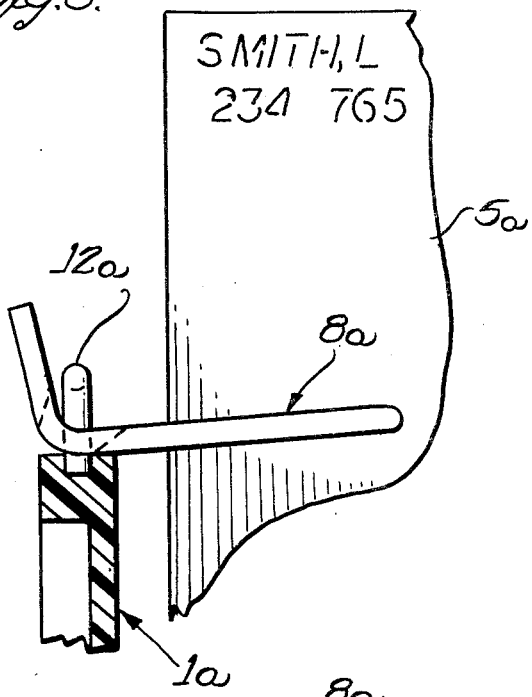
FIG. 6 is a view similar to FIG. 5 but shows the plate in a forward or operative position.
Figure 7:
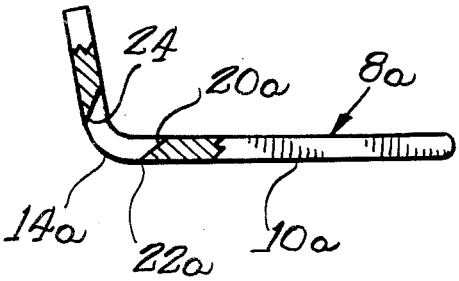
FIG. 7 is an edge view of the plate shown on FIGS. 5 and 6 partially broken away to show certain structural features in greater detail.
Figure 8:
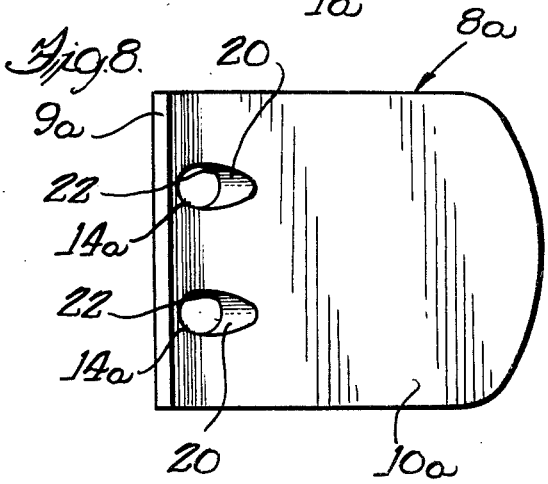
FIG. 8 is a plan view of the plate member shown in FIG. 7.
Figure 9:
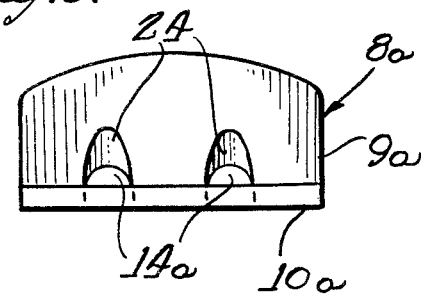
FIG. 9 shows the plate member as viewed from the right hand end of FIG. 7.

Referring now to FIGS. 5–10, a modified form of the present invention shown similar to the structure described above as indicated by the application of identical reference numerals with the suffix A added to corresponding elements. In this embodiment, the frame 1A, drum 4A and cards 5A are indentical to the corresponding elements previously described. In this embodiment, the pivotal and rolling motion of the plate member 8A has moved between the generally upright retracted position shown in FIG. 5 and the extended operative position shown in FIG. 6 is further promoted by the modified structure of the staple 12A and the plate member itself. More specifically, the plate member is formed so that there is an angle in excess of 90° between the body portion 10A and the lip portion 9A. In the embodiment shown, this angle is approximately 100° so that, is shown in FIG. 5, when the plate member is in the retracted position, the body portion 10A is inclined from the vertical and rests against and is supported by edges of the cards 5A. The length and inclination of the body portion 10A causes the plate member to be biased by gravity so that when the cards are manually spread by an operator, the plate member readily falls from the retracted position to the extended operative position shown in FIG. 6.

It is further important to note the modified structure of the apertures 14A in this embodiment. More specifically, rather than being essentially elliptical, the apertures 14A are generally circular as shown best in FIG. 8 and have a diameter slightly greater than the diameter of the wire stock material from which the staple 12 is made. However the upper surface of the body portion 10A is formed with a generally elliptical recess 20 which inclines upwardly from a narrow edge 22 at the junction between the aperture 14A and the bottom surface of the plate member. In addition, a similar recessed surface 24 is formed in the lip portion 9A generally oppositely from the inclined recessed surface 20 associated with each of the apertures 14A. The arrangement is such that the narrow edge 22 which defines the bottom of each of the apertures 18A provides a fulcrum presenting a knife like edge for substantially line contact with an associated leg element of the staple 12A. This structure facilitates upper pivotal movement of the plate member from the extended operative position shown in FIG. 6 toward the retracted position shown in FIG. 5 in response to the lifting action provided by the cards when the drum is manually rotated as described above. The recesses 20 and 24 associated with the aperture means are formed so as to provide efficient clearance to permit the plate member to fall to the operative position as shown in FIG. 6.

Figure 10:
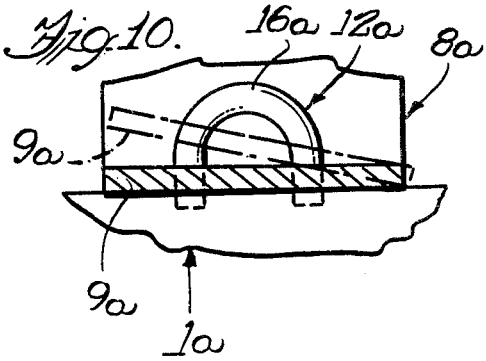
FIG. 10 is a fragmentary sectional view taken along line 10—10 in FIG. 5.

As shown in FIG. 10, the staple member 12A is formed so that its leg elements 17A are inclined or curved inwardly so as to join almost immediately with the arcuate bight portion 16A. This construction promotes a lifting or rolling action of the plate member as indicated in broken lines in FIG. 10 for facilitating pivoting of the plate member from the lowered operative position to the generally upright retracted position.

While preferred embodiments of the present invention have been shown and described herein, it is obvious that many structural details may be changed without departing from the spirit and scope of the appended claims.

The invention is claimed as follows:

1. A rotary card index system comprising rotatable drum means for carrying a plurality of radially extending cards and for causing said cards to rotate therewith in either a clockwise or counterclockwise direction, support means for said drum means, a member movable along a plane generally parallel to the axis of rotation of said drum means to and from an operable position between adjacent cards on said drum means for maintaining a space between said adjacent cards and a retracted position and means mounting said member on said support means for bodily movement about compound axes between said operable and retracted positions responsive to the rotation of said cards in either said clockwise or counterclockwise directions.

2. A rotary card index system, as defined in claim 1, wherein said mounting means includes means for connecting said member with said support means for compound pivotal movement from said operable position to said retracted position generally between right angularly disposed axes of said member under a camming action from one of said adjacent cards upon rotation of said drum means.

3. A rotary card index system, as defined in claim 2, wherein said mounting means comprises a pair of spaced apart aperture means in said member, and a pair of upstanding elements fixed to said support means and respectively extending into said aperture means.

4. A rotary card index system, as defined in claim 3, wherein said member includes a plate comprising a body portion for projecting between said adjacent cards and a lip portion extending angularly from said body portion and joined to the body portion along a bend portion, said aperture means traversing said bend portion.

5. A rotary card index system comprising side support means including an upstanding side wall having an upper margin, rotatable drum means carried by said side support means and extending generally horizontally with respect to said wall and carrying a plurality of radially extending cards, a member including an elongate body portion and a mounting end portion movable to and from an operable position about said mounting end portion between adjacent cards on said drum means for maintaining a space between said adjacent cards and a retracted position, and means mounting said member mounting end portion to said support means wall for bodily movement about compound axes between said operable and retracted positions, said body portion presenting an engaging edge to said cards when in said operable position to cause said cards to engage said engaging edge and move said member from said operable position to said retracted position upon rotation of said cards.

6. A rotary card index system, as defined in claim 5, wherein said member comprises a plate including a body portion for extending between said adjacent cards and an angularly disposed lip portion, and said mounting means comprises a pair of spaced aperture means in said plate and each extending partially in said body portion and said lip portion, and a generally inverted U-shaped means including spaced apart leg elements secured to said upper margin of said wall and extending through said aperture means.

7. A rotary card index system, as defined in claim 6, wherein each of said aperture means has a generally elliptical configuration with a major axis traversing a junction between said body portion and said lip portion.

8. A rotary card index system, as defined in claim 7, wherein said inverted U-shaped means includes an arcuate bight portion joining upper ends of said leg elements.

9. A rotary card index system, as defined in claim 6, wherein each of said aperture means is defined at least partially by knife edge fulcrum means engaged with an associated leg element of said U-shaped means for facilitating pivotal movement of said plate from the operable position to the retracted position.

10. A rotary index system as defined in claim 6, wherein said lip portion extends from said body portion at an angle in excess of 90° and is adapted to rest on said upper margin of the extending wall when said plate is in retracted position, said body portion being inclined from the vertical when said plate is in said retracted position for promoting movement to the operable position under the influence of gravity.

11. A rotary card index system comprising support means including an upstanding wall having an upper margin, rotatable drum means carried by said support means and extending generally horizontally with respect to said wall and carrying a plurality of radially extending cards, a member including a body portion movable to and from an operable position between adjacent cards on said drum means for maintaining a space between said adjacent cards and a retracted position, and means mounting said member on said support means wall for bodily movement about compound axes between said operable and retracted positions, said body portion including tapering edge means engageable by one said adjacent cards upon rotation of said drum means for promoting camming of said member in a pivotal manner from said operable position towards said retracted position.

12. A rotary card index system comprising support means including an upstanding wall having an upper margin, rotatable drum means carried by said support means and extending generally horizontally with respect to said wall and carrying a plurality of radially extending cards, a plate including a body portion for extending between adjacent cards and an angularly disposed lip portion, said plate being movable to and from an operable position between said adjacent cards and a retracted position, mounting means mounting said plate on said support means wall including a pair of spaced aperture means in said plate and each extending partially in said body portion and said lip portion, and a generally inverted U-shaped means including spaced apart leg elements secured to said upper margin of said wall and extending through said aperture means, each of said aperture means being generally circular in configuration, and recess means in upper surfaces of said body and lip portions and merging with each of said aperture means for facilitating pivotal movement of the plate between said retracted and operable positions.

13. A rotary card index system, as defined in claim 12, wherein said leg elements have a circular cross-sectional configuration of predetermined diameter, and each of said aperture means has a diameter greater than said predetermined diameter.

* * * * *